US009416945B2

(12) United States Patent
Chung et al.

(10) Patent No.: US 9,416,945 B2
(45) Date of Patent: Aug. 16, 2016

(54) LIGHTING APPARATUS

(71) Applicant: Sang Min Chung, Seoul (KR)

(72) Inventors: Sang Min Chung, Seoul (KR); Hyeon Seong Jeong, Seongnam-si (KR)

(73) Assignee: Sang Min Chung (KR)

( * ) Notice: Subject to any disclaimer, the term of this patent is extended or adjusted under 35 U.S.C. 154(b) by 136 days.

(21) Appl. No.: 14/369,354

(22) PCT Filed: Dec. 28, 2012

(86) PCT No.: PCT/KR2012/011792
§ 371 (c)(1),
(2) Date: Jun. 27, 2014

(87) PCT Pub. No.: WO2013/100728
PCT Pub. Date: Jul. 4, 2013

(65) Prior Publication Data

US 2014/0355279 A1 Dec. 4, 2014

(30) Foreign Application Priority Data

Dec. 29, 2011 (KR) ..... 10-2011-0146102

(51) Int. Cl.

| | |
|---|---|
| ***F21V 17/02*** | (2006.01) |
| ***F21S 6/00*** | (2006.01) |
| ***F21V 21/14*** | (2006.01) |
| ***F21V 21/28*** | (2006.01) |
| *F21S 8/00* | (2006.01) |

(52) U.S. Cl.
CPC ..... *F21V 17/02* (2013.01); *F21S 6/003* (2013.01); *F21S 6/006* (2013.01); *F21V 21/14* (2013.01); *F21V 21/28* (2013.01); *F21S 8/033* (2013.01)

(58) Field of Classification Search
CPC ..... F21V 17/02; F21V 21/14; F21V 21/28; F21S 6/006; F21S 6/003; F21S 8/033
See application file for complete search history.

(56) References Cited

U.S. PATENT DOCUMENTS

| | | | |
|---|---|---|---|
| 3,243,497 | A | 3/1966 | Kendall et al. |
| 4,770,384 | A | 9/1988 | Kuwazima et al. |
| 2011/0114803 | A1 | 5/2011 | Lee et al. |

FOREIGN PATENT DOCUMENTS

| | | |
|---|---|---|
| DE | 102009037019 | 3/2011 |
| JP | H1122185 | 1/1999 |
| JP | 2005019043 | 1/2005 |
| KR | 2019980067514 | 12/1998 |
| KR | 200271019 | 4/2002 |

(Continued)

OTHER PUBLICATIONS

International Search Report, PCT/KR2012/011792, Apr. 24, 2013.

*Primary Examiner* — Joseph L Williams
(74) *Attorney, Agent, or Firm* — Perman & Green, LLP

(57) ABSTRACT

Provided is a lighting apparatus. The lighting apparatus includes a base unit, a first rod-shaped member, a second rod-shaped member and a middle connection unit, wherein the middle connection unit includes a first frame fixed at the other end of the first rod-shaped member, a second frame fixed to the other end, having a form corresponding to the first frame, and coupled to the first frame to be rotatable with respect to the first frame, at least one guide elongate hole provided for any one of the first and second frames, extending along an arc, and penetratively formed, and a guide pin unit fixed to the remaining one of the first and second frames and fixed to be movable along the guide elongate hole.

9 Claims, 8 Drawing Sheets

(56) References Cited

FOREIGN PATENT DOCUMENTS

| | | |
|---|---|---|
| KR | 200432747 | 12/2006 |
| KR | 1020100123529 | 1/2011 |
| TW | 333299 | 5/1997 |
| WO | 2004063619 | 7/2004 |

LIGHTING APPARATUS

CROSS-REFERENCE TO RELATED APPLICATIONS

This Application is the National Stage of International Application No. PCT/KR2012/011792 having international filing date 28 Dec. 2012, which designated the United States of America, and which International Application was published under PCT Article 21(s) as WO Publication 2013/100728 A1 and which claims priority from, and the benefit of, Korean Application No. 10/2011/0146102 filed December 2011, the disclosures of which are incorporated herein by reference in their entireties.

BACKGROUND

The presently disclosed embodiment relates to a lighting apparatus, and more particularly, to a lighting apparatus having an improved structure of a middle connection unit in order to allow a user to change a position of a lighting unit more conveniently and smoothly.

In general, lighting apparatuses include various light sources such as fluorescent lamps, incandescent lamps, and LED bulbs, and their specific forms vary.

Among such lighting apparatuses, a lighting apparatus such as a ceiling lamp is installed on a ceiling of a house or an office to light up a wide range of an area and a light apparatus such as a desk stand is used to light up a relatively small range of an area.

Especially, a lighting apparatus such as a table stand is put on a desk or a floor during use, or its base unit is fixed on a wall for use. When a user reads a book or lighting for a limited space is required by a certain need, such a lighting apparatus is widely used as a necessary illumination for a necessary place because its lighting unit including a light source is movable.

A lighting apparatus such as a table stand typically includes a base unit, a rod-shaped member connected to the base unit, and a lighting unit connected to an end portion of the rod-shaped member and provided with a light source to emit light.

Additionally, in the case of a lighting apparatus that is the subject of the presently disclosed embodiment, since a rod-shaped member includes a first rod-shaped member and a second rod-shaped member, a lighting unit may easily moves to a desired position. A movable middle connection unit such as a joint is provided at a portion connecting the first and second rod-shaped members mutually.

However, in the case of the lighting apparatus including such a related art middle connection unit, since a relative movement of the second rod-shaped member with respect to the first rod-shaped member is dissatisfied due to the structural limitations of the middle connection unit, a user may not conveniently move or cannot move the position of the lighting unit.

The presently disclosed embodiment provides a solution to resolve the issues that a lighting apparatus including a middle connection unit has, and thus, provides a lighting apparatus that allows a relative movement of a second rod-shaped member with respect to a first rod-shaped member to be made more easily and more conveniently with less power.

SUMMARY

According to an aspect of the presently disclosed embodiment, there is provided a lighting apparatus including: a base unit disposed on a flat surface or fixed on a wall; a first rod-shaped member whose one end portion is coupled to the base unit; a second rod-shaped member having one end portion provided with a lighting unit; and a middle connection unit connecting the other end portion of the first rod-shaped member and the other end portion of the second rod-shaped member mutually, wherein the middle connection unit includes: a first frame fixed at the other end part of the first rod-shaped member; a second frame fixed to the other end portion of the second rod-shaped member, having a form corresponding to the first frame, and coupled to the first frame to be rotatable with respect to the first frame; at least one guide elongate hole provided for any one of the first and second frames, extending along an arc, and penetratively formed; and a guide pin unit fixed to the remaining one of the first and second frames and fixed to be movable along the guide elongate hole.

An entire form of each of the first and second frames may be a substantially ring form.

At least two guide elongate holes may be formed spaced apart from each other in any one of the first and second frames; and the guide pin unit may be fixed to the remaining one of the first and second frames and fixed in correspondence to each of the guide elongate holes.

The length of each of the guide elongate holes may be formed to allow the size of the central angle of an arc corresponding to the guide elongate hole to become about 60° or less and thus is configured to limit a relative rotating operation of the first and second frames to be about 60° or less.

One end portion of the guide pin unit may be fixed to the remaining one of the first and second frames; the other end portion of the guide pin unit may have a size greater than a width of the guide elongate hole; and a main body connecting the one end portion and the other portion of the guide pin unit may penetrate the guide elongate hole.

The guide pin unit may further include a bearing member at an outer side of the main body, so that the bearing member contacts an inside of the guide elongate hole.

The lighting apparatus may further include: an elastic supporting unit disposed at one of the first and second frames facing each other and elastically supporting the other frame; and an inclined unit disposed at the remaining one of the first and second frames and having an inclined plane, which protrudes along a moving trajectory of an arc form where the elastic supporting unit moves when the first and second frames move relatively and which is formed to allow the protruding height to be gradually higher or lower along the arc.

The elastic supporting unit may include a groove portion having a concave form, an elastic member in the groove portion, and a ball member elastically supported by the elastic member.

In order to allow an angle between the second rod-shaped member and the first rod-shaped member to be smaller, as the second frame rotates with respect to the first frame, the inclined plane of the inclined unit may be formed to have a height that becomes gradually higher to press the elastic supporting unit further.

Each of the first and second frames may be provided vertically; and the lighting apparatus may further include a case unit at the outer sides of the first and second frames to cover the entire first and second frames.

According to a lighting apparatus of the presently disclosed embodiment, in order for a user to change the posture or position of a lighting unit, an operation of a middle connection unit is made smoothly with less power.

DETAILED DESCRIPTION

Hereinafter, aspects of the presently disclosed embodiment will be described in more detail with reference to the accompanying drawings.

Referring to FIGS. 1 to 9, the lighting apparatus of the presently disclosed embodiment may be implemented as a table stand mainly used to put on a desk, but is not limited thereto. That is, it is possible to make various modifications adapting a configuration of a middle connection unit. That is, a lighting apparatus having a base unit fixed on a wall may be used as an embodiment.

Figure 1:
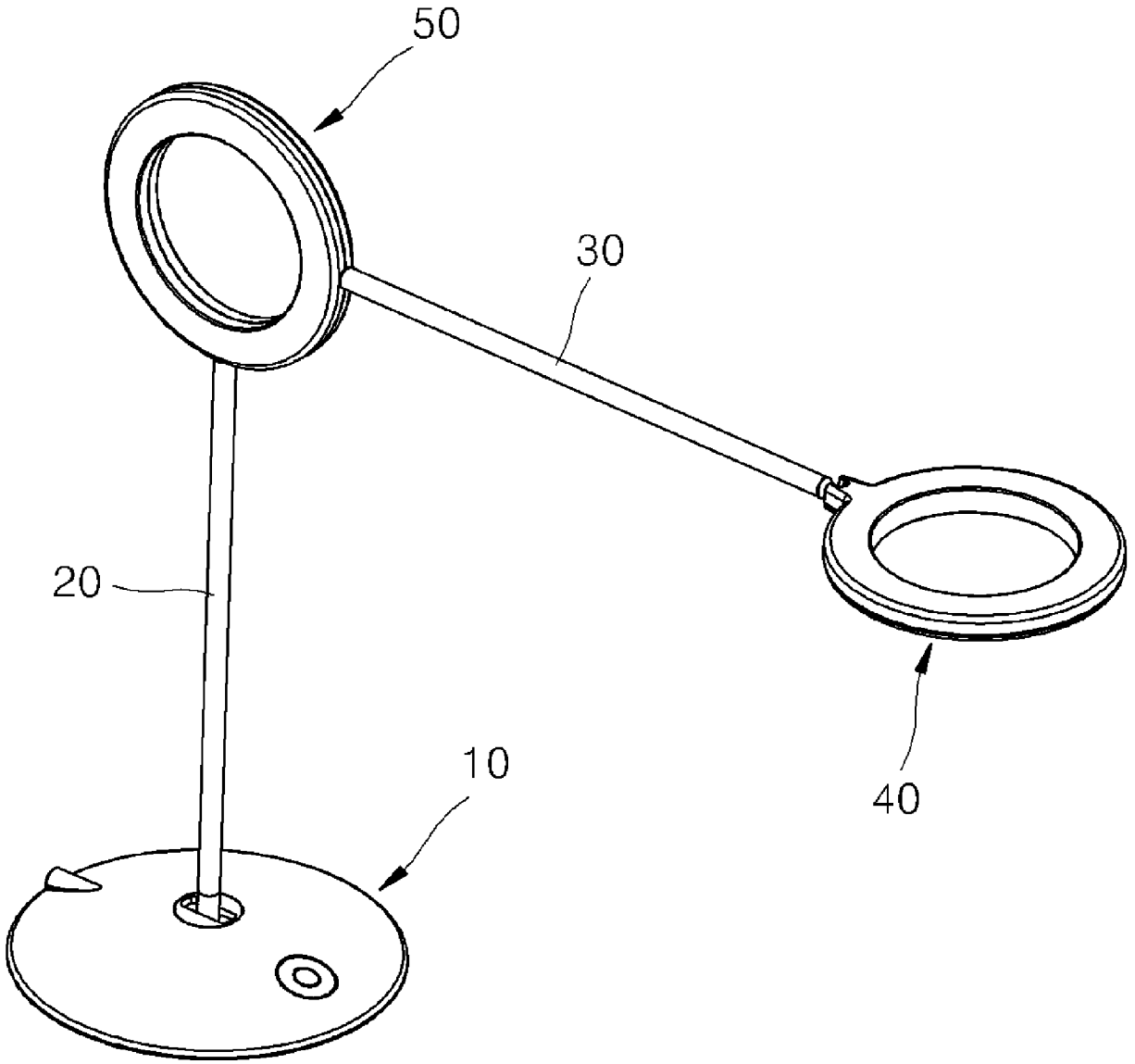
FIG. 1 is a perspective view of a lighting apparatus according to an aspect of the presently disclosed embodiment.
Figure 2:
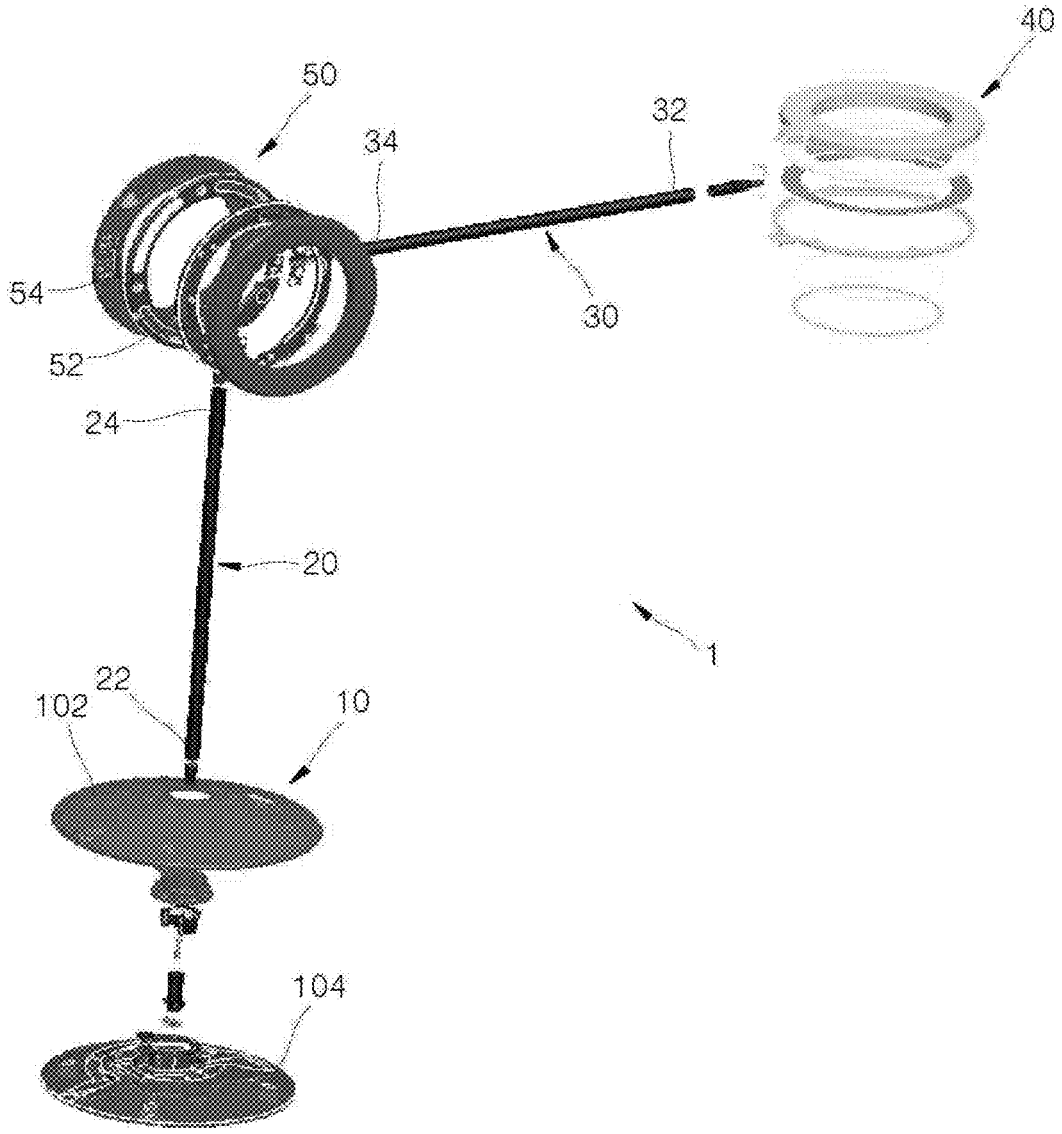
FIG. 2 is a schematic partial exploded perspective view of the lighting apparatus of FIG. 1.
Figure 3:
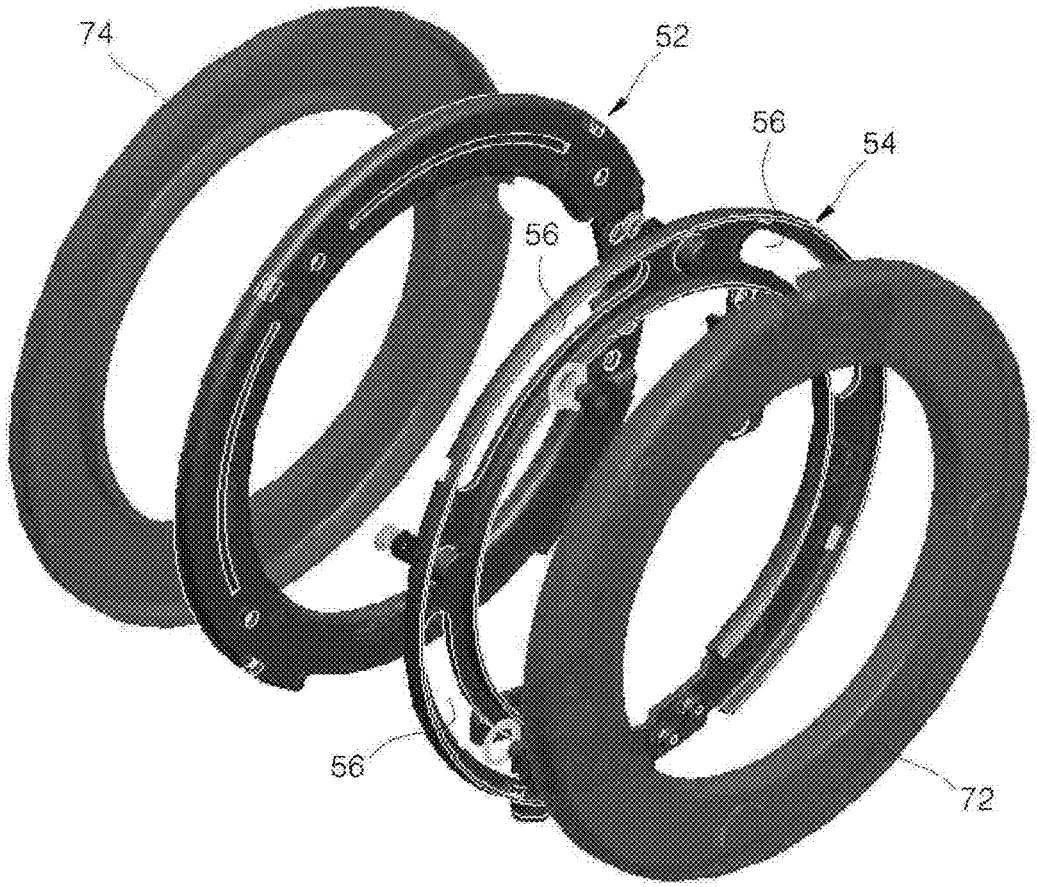
FIG. 3 is a schematic exploded perspective view of a middle connection unit of FIG. 1.

The lighting apparatus 1 of FIG. 1, as a lighting apparatus for a table stand mainly put on a desk or a table, may include a base unit 10, a first rod-shaped member 20, a second rod-shaped member 30, a lighting unit 40, and a middle connection unit 50.

The base unit 10 is put on the top surface of a desk in use in which other elements configuring the lighting apparatus are connected to and supported by the base unit 10. The base unit 10 may be made heavily in order to provide stability during operations of other elements. In another embodiment, the base unit may be fixed on a wall for use, and may be put on a floor for use.

In this aspect, the base unit 10 includes an upper case 102 and a lower case 104, which are mutually coupled to each other. The upper case 102 may be detachably coupled to the lower case 104.

The first rod-shaped member 20 has one end 22, i.e. a lower end, connected to the base unit 10 and the other end 24, i.e. an upper end, coupled to the middle connection unit 50. The first rod-shaped member 20, as a thin and long member in a lengthy direction, may be a hollow pipe or may be a pole member having a cross-section of a circular or polygonal form.

The lighting unit 40 is provided at one end 32 of the second rod-shaped member 30. Like the first rod-shaped member 20, the second rod-shaped member 30, as a thin and long member in a lengthy direction, may be a hollow pipe or may be a pole member having a cross-section of a circular or polygonal form.

The other end 24 of the first rod-shaped member 20 and the other end 34 of the second rod-shaped member 30 are mutually connected to each other through the middle connection unit 50. The middle connection unit 50 serves to provide a relative movement of the second rod-shaped member with respect to the first rod-shaped member 20 and support the second rod-shaped member 30 at a desired position.

The middle connection unit 50 includes a first frame 52, a second frame 54, a guide elongate hole 56, and a guide pin unit 58.

The first frame 52 is fixed to the other end 24 of the first rod-shaped member 20. A first frame supporting shaft 522 inserted into and fixed to the first rod-shaped member 20 is provided at one side of the first frame 52. The first frame supporting shaft 522 is fixed to one side of the first frame 52 by screws 523.

The second frame 54 is fixed at the other end 34 of the second supporting shaft member 30. The second frame 54 has a form corresponding to the first frame 52 and is coupled to the first frame to be rotatable with respect to the first frame 52.

A second frame supporting shaft 542 inserted into and fixed to the second sealing member 30 is provided at one side of the second frame 54. The second frame supporting shaft 542 is fixed to one side of the second frame 54 by screws 543.

In the case of this aspect, an overall form of the first and second frames 52 and 54 is substantially ring form. The substantially ring form does not need to necessarily fit the definition of a mathematical or lexicographical ring form, and means a donut form or a circular plate having a middle hole.

Additionally, in the case of this aspect, the first and second frames 52 and 54 are provided vertically. Additionally, a case unit covering the first and second frames 52 and 54 entirely is further provided at the outer sides of the first and second frames 52 and 54. The case unit includes a second case unit 74 and a first case unit contacting the first and second frames 52 and 54, respectively.

Moreover, in the case of another aspect, if only a mutual relative circular movement is performed, the first and second frames may have a circular plate form instead of a ring form. Additionally, an overall form of the first frame may not be a circle but may be a rectangular plate. At this point, a plurality of guide elongate holes are mutually spaced apart from each other along the circumference.

The second frame 54 includes the guide elongate hole 56. The penetrated portion of the guide elongate hole 56 extends along the arc on the circumference of the second frame 54. The guide elongate hole 56 is provided a total of three in the case of this aspect.

The length of each guide elongate hole 56 is formed to allow the size of the central angle of an arc corresponding to the guide elongate hole 56 to be about 60° or less and thus is configured to allow a relative rotating operation of the first and second frames 52 and 54 to be about 60° or less.

Moreover, in the case of this aspect, under the assumption that the first rod-shaped member 20 is disposed vertically and the second rod-shaped member 30 is disposed horizontally, the second rod-shaped member 30 fixed to the second frame 54 is configured to rotate in a range of about 25° upwards to 30° downwards. According to an aspect, such a rotatable range angle may vary if necessary.

Additionally, in the case of another aspect, the lengths and number of the guide elongate holes may vary if necessary. Additionally, the guide elongate hole may be formed in the first frame and the guide pin unit may be formed at the second frame.

The guide pin unit 58 is fixed at the first frame 52 to be movable along the guide elongate hole 56. In the case of this embodiment, the number of the guide pin units 58 is three in correspondence to the number of the guide elongate holes 56.

Figure 9:
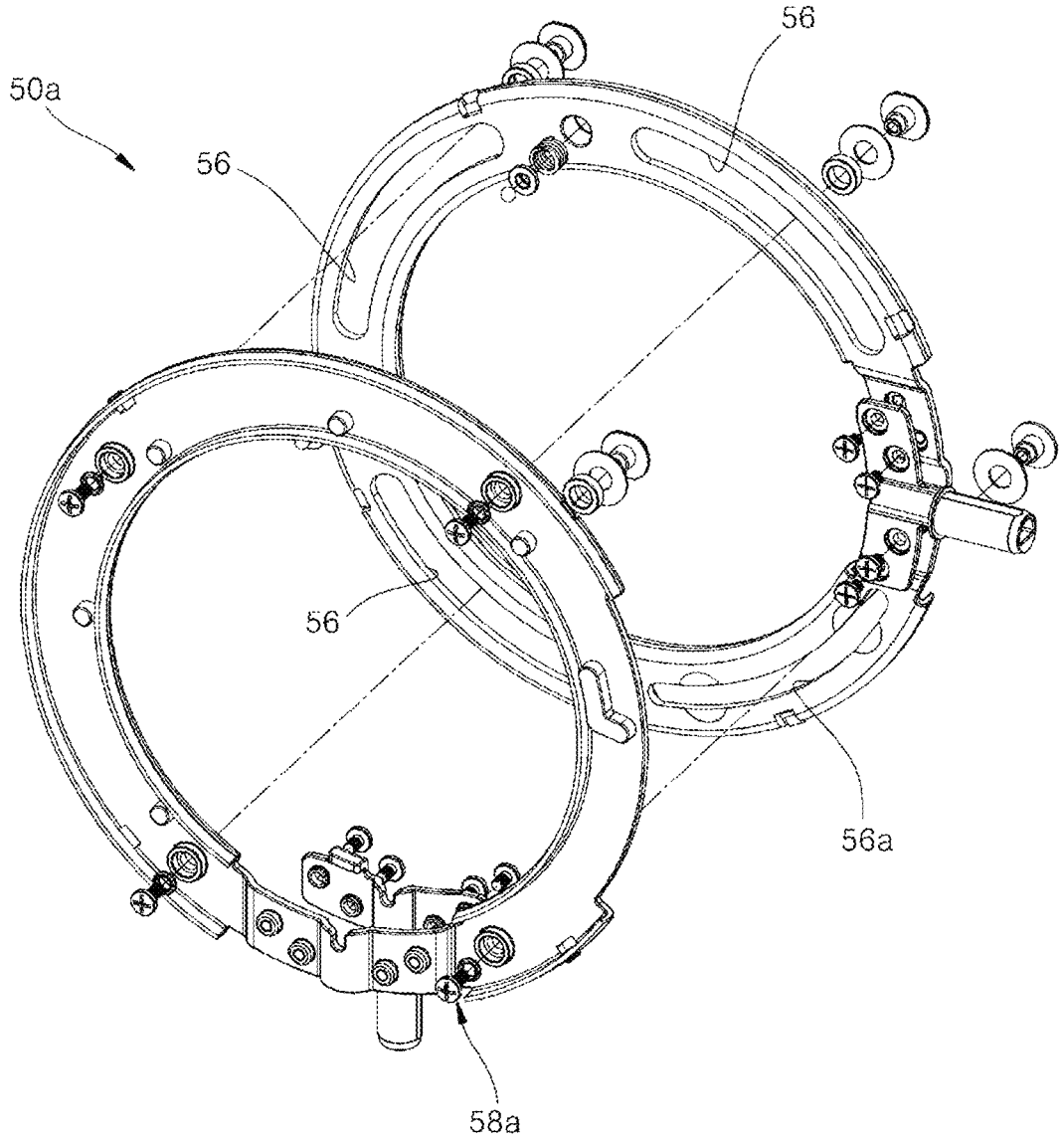
FIG. 9 is a view when a middle connection unit of FIG. 5 further includes another guide elongate hole and another guide pin unit according to another aspect of the presently disclosed embodiment.

Moreover, a modified middle connection unit 50*a* having four guide elongate holes and four guide pin units is shown in FIG. 9. When compared with the previous embodiment, one guide elongate hole 56*a* and one guide pin unit 58*a* corresponding thereto are further provided. According to this embodiment, the first and second frames may be more firmly coupled to each other in terms of additional effects.

In this aspect, the guide pin unit 58 includes a screw 581, a washer 582, a pin 584, and a bearing member 587.

The head portion of the screw 581 configures one end of the guide pin unit 58 and is fixed to the first frame 52. The pin 584 includes a diameter enlarging portion 583 and a body portion 585. The diameter enlarging portion 583 of the pin configures the other end of the guide pin unit and the size of its diameter is greater than the width of the guide elongate hole 56.

The body portion 585 of the pin configures a body portion connecting the one end and the other end of the guide pin unit 58. The body portion 585 is configured to penetrate the guide elongate hole 56.

Additionally, in the case of this aspect, the guide pin unit 58 further includes a bearing member 587 at the outer side of the body portion 585. The bearing member 587 is configured to contact the inside of the guide elongate hole 56, so that the guide pin unit 58 may move in the guide elongate hole 56 more smoothly. The washer 582 is inserted into and fixed to the screw 581.

Additionally, in the case of this aspect, an elastic supporting unit 60 and an inclined unit 62 are further included.

The elastic supporting unit 60 is disposed at the side where the second frame faces the first frame. The elastic supporting unit 60 supports the first frame elastically.

The elastic supporting unit 60 includes a groove unit 601 having a concave form, an elastic member 603 in the groove unit 601, and a ball 605 elastically supported by the elastic member 603. The ball 605 is received into a ball holder 604 contacting the elastic member 603.

Figure 4:
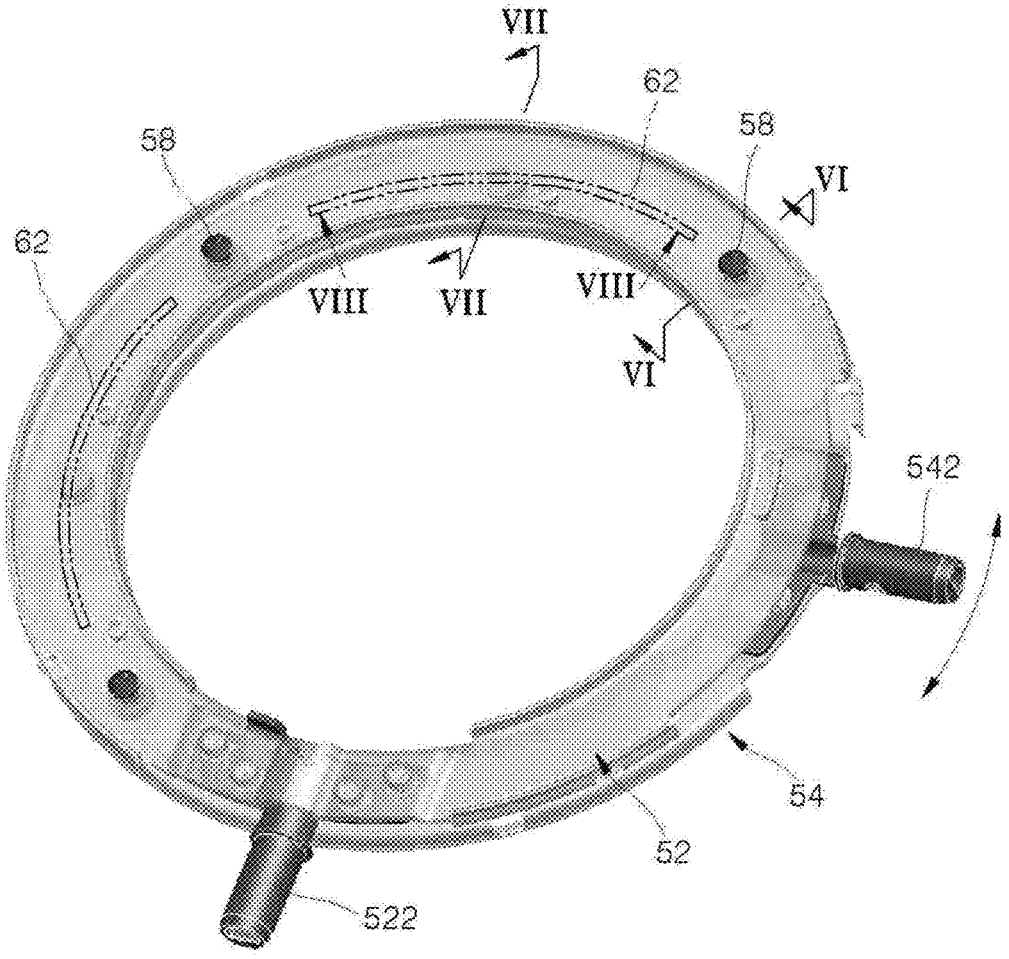
FIG. 4 is a schematic perspective view when a first frame and a second frame of FIG. 3 are coupled to each other.
Figure 5:
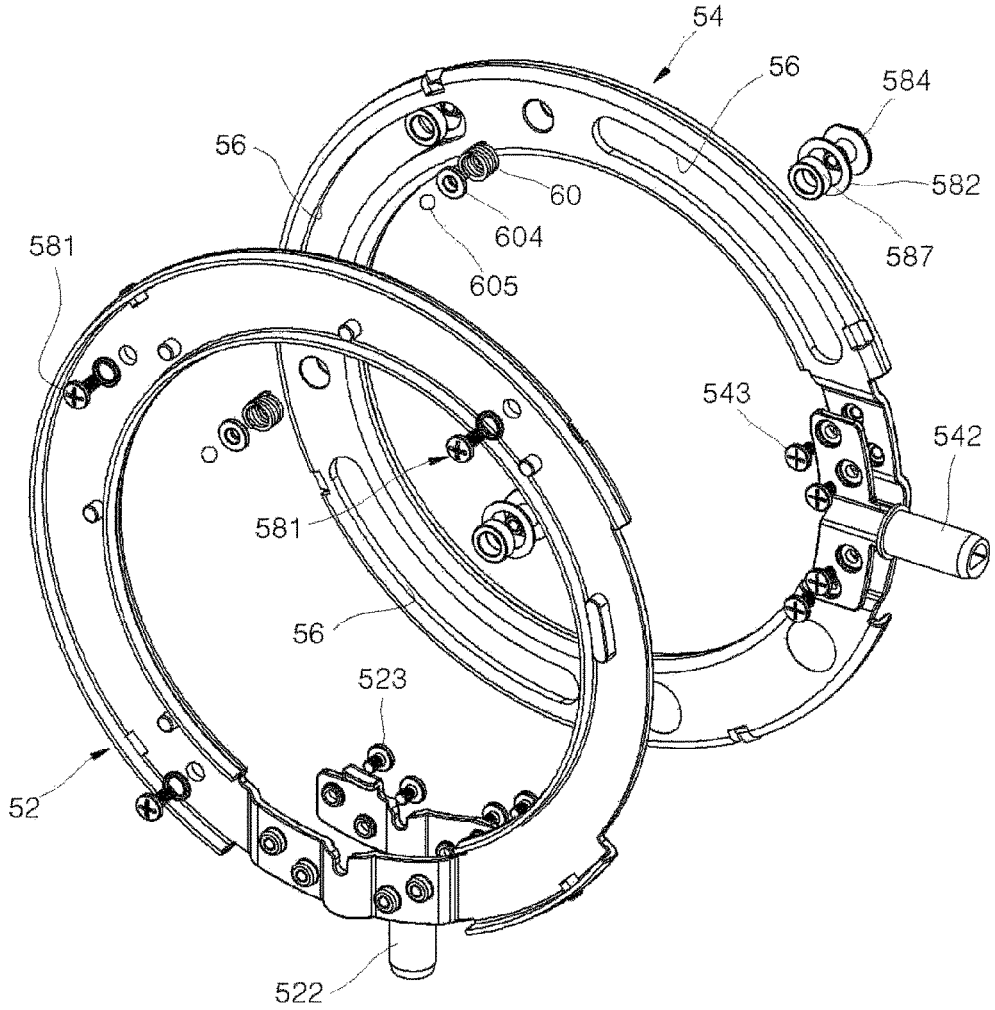
FIG. 5 is a schematic exploded perspective view of the first frame and the second frame of FIG. 4.
Figure 6:
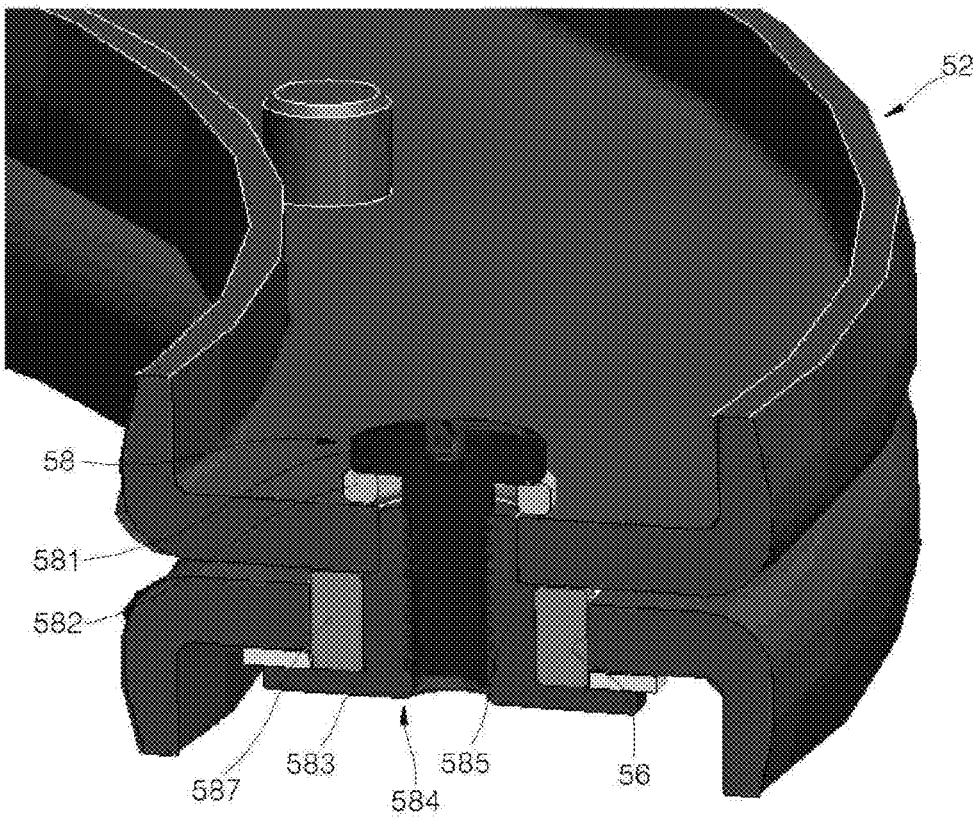
FIG. 6 is a schematic cross-sectional view taken along line VI-VI of FIG. 4.
Figure 7:
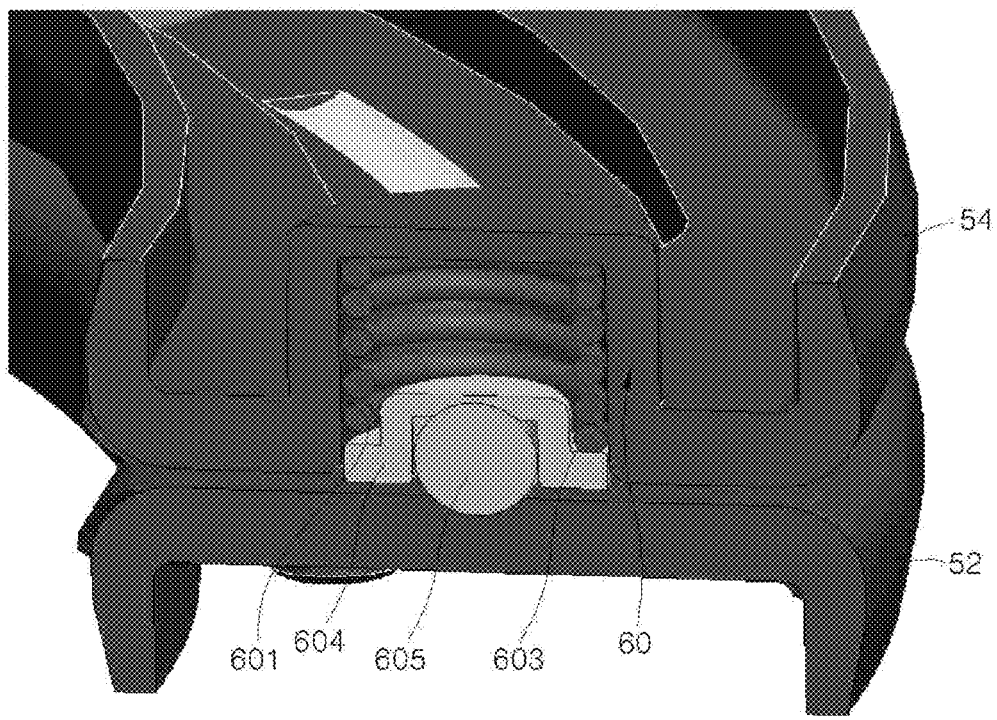
FIG. 7 is a schematic cross-sectional view taken along line VII-VII of FIG. 4.
Figure 8:
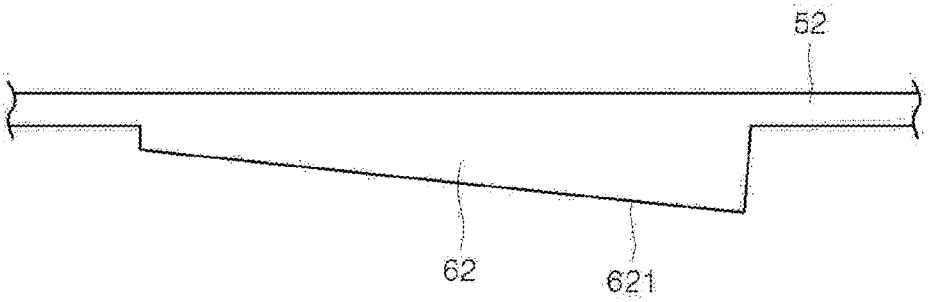
FIG. 8 is a conceptual cross-sectional view taken along line VIII-VIII of FIG. 4.

The inclined unit 62 is indicated with a virtual line as shown in FIG. 4. Referring to FIG. 8, which is a conceptual cross-sectional view taken along arc VIII-VIII of FIG. 4, the inclined unit 62 becomes greater as its protruding height moves to the right gradually along the arc. The protruding height and the inclination degree of the inclined plane may be appropriately adjusted in consideration of elasticity and the weight of the lighting unit.

As the second frame 54 having the elastic supporting unit 60 rotates with respect to the first frame 52, the ball 605 is pressed against the elastic force of the elastic member 603, due to the inclined plane 621 of the inclined unit 62 protruding along the moving trajectory of the arc form where the elastic supporting unit 60 moves. The power by the elastic force of the elastic member 603 is balanced with the weight of the lighting unit, so that the position of the second frame is stably maintained always even when moving.

In the case of this aspect, as the second frame 54 rotates with respect to the first frame 52 to allow an angle between the second rod-shaped member 30 and the first rod-shaped member 20 to be smaller, the height of the inclined plane 621 of the inclined unit 62 becomes higher, so that the elastic member 603 of the elastic supporting unit is further pressed.

That is, when the second rod-shaped member 30 is lowered from the horizontal plane, the elastic member 603 is further pressed. Due to such a configuration, the second rod-shaped member 30 is stably placed at any position and when a user raises up the second rod-shaped member 54 that is below the horizontal plane, it is possible for the second rod-shaped member 30 to move with less power, with the help of the elastic member 603.

Moreover, in the case of another aspect, the formation position of the elastic supporting unit and the inclined unit may vary between the first and second frames if necessary, and also the number of the units may vary.

Hereinafter, the action and effect of the lighting apparatus 1 having the above configuration are described.

Since the lighting apparatus 1 of this embodiment includes the middle connection unit 50 having the first and second frames 52 and 54, the guide elongate hole 56, and the guide pin unit 58, a mutual movement may be possible only within a desired angle.

As mentioned above, since the guide pin unit 58 has the bearing, a movement between the first and second frames may be made smoothly.

Additionally, in the case of this embodiment, since the elastic supporting unit 60 and the inclined unit 62 are provided, the vertical movement of the second rod-shaped member 30 is made smoothly with less power, and it may be stably placed at a desired position.

That is, when the lighting unit 40 of the second rod-shaped member 30 is raised upward, a portion of the inclined unit contacting the elastic supporting unit is moved to a portion having a lower height, so that the amount of press in the elastic member 603 becomes smaller gradually, and also, when lighting unit 40 of the second rod-shaped member 30 is lowered, a portion of the inclined unit contacting the elastic supporting unit is moved to a higher place, so that the amount of press in the elastic member 603 becomes larger gradually. The elastic force of the elastic supporting unit including such an elastic member and the weight of a portion including the lighting unit are equilibrated. As a result, when the position of the lighting unit is changed, a user may feel an unparalleled degree of softness and convenience when compared with a lighting apparatus including a related art middle connection unit.

REFERENCE NUMERALS

1 . . . lighting apparatus
10 . . . base unit
20 . . . first rod-shaped member
30 . . . second rod-shaped member
40 . . . lighting unit
50,50*a* . . . middle connection unit
52 . . . first frame
54 . . . second frame
56 . . . guide elongate hole
58 . . . guide pin unit
60 . . . elastic supporting unit
62 . . . inclined unit

The invention claimed is:

1. A lighting apparatus comprising:

a base unit disposed on a flat surface or fixed on a wall;

a first rod-shaped member having one end coupled to the base unit;

a second rod-shaped member including a lighting unit at a first end thereof; and a middle connection unit connecting another end of the first rod-shaped member and a second end of the second rod-shaped member mutually, wherein the middle connection unit comprises:

a first frame fixed to the other end of the first rod-shaped member;

a second frame fixed to the second end of the second rod-shaped member, having a form corresponding to the first frame, and coupled to the first frame to be rotatable with respect to the first frame;

at least one guide elongate hole provided for any one of the first and second frames, extending along an arc, and penetratively formed; and a guide pin unit fixed to the remaining one of the first and second frames and fixed to be movable along the guide elongate hole;

wherein an elastic supporting unit is disposed at a side of one of the first or second frames where the first and second frames face each other and elastically supports a remaining one of the first and second frames, and an inclined unit disposed at a side of the remaining one of the first and second frames and having an inclined surface, which protrudes along an arcuate trajectory along which the elastic supporting unit moves when the first and second frames move relative to each other, where the elastic supporting unit engages the inclined surface and the inclined surface is formed so that a protruding height of the inclined surface is gradually, higher or lower along a length of the arcuate trajectory.

2. The lighting apparatus of claim 1, wherein an entire form of each of the first and second frames is a substantially ring form.

3. The lighting apparatus of claim 2, wherein at least two the guide elongate holes are spaced apart from each other in one of the first and second frames; and the guide pin unit is fixed to the remaining one of the first and second frames and is fixed in correspondence to each of the guide elongate holes.

4. The lighting apparatus of claim 3, wherein the length of each of the guide elongate hole is formed to allow the size of the central angle of an arc corresponding to the guide elongate hole to be about 60° or less and thus is configured to allow a relative rotating operation of the first and second frames to be about 60° or less.

5. The lighting apparatus of claim 1, wherein one end of the guide pin unit is fixed to the remaining one of the first and second frames;

the other end of the guide pin unit has a size greater than a width of the guide elongate hole; and a main body connecting the one end and the other end of the guide pin unit penetrates the guide elongate hole.

6. The lighting apparatus of claim 5, wherein the guide pin unit further comprises a bearing member at an outer side of the main body, and the bearing member contacts an inside of the guide elongate hole.

7. The lighting apparatus of claim 1, wherein the elastic supporting unit comprises a groove unit having a concave form, an elastic member in the groove unit, and a ball member elastically supported by the elastic member.

8. The lighting apparatus of claim 1, wherein in order to allow an angle between the second rod-shaped member and the first rod-shaped member to be smaller, as the second frame rotates with respect to the first frame, the inclined surface of the inclined unit is formed to have a height that becomes gradually higher to press the elastic supporting unit further.

9. The lighting apparatus of claim 1, wherein each of the first and second frames is provided vertically; and further comprising a case unit at the outer sides of the first and second frames to cover the entire first and second frames.

* * * * *